United States Patent [19]

McWilliams et al.

[11] Patent Number: 4,851,980

[45] Date of Patent: Jul. 25, 1989

[54] DOUBLE DRUM LEVEL WINDING ROPE LIFT MECHANISM FOR LUMINAIRES ON HIGH LIGHTING MASTS

[75] Inventors: Archie McWilliams, Crete, Ill.; Clyde A. Foor, Poland; Daniel J. Love, New Middletown, both of Ohio

[73] Assignee: Meade Industrial Services, Inc., Hammond, Ind.

[21] Appl. No.: 213,187

[22] Filed: Jun. 29, 1988

[51] Int. Cl.[4] ..... F21V 21/36

[52] U.S. Cl. ..... 362/403; 362/250; 362/286; 362/431; 254/285

[58] Field of Search ..... 362/250, 285, 286, 391, 362/403, 431; 242/158.2; 254/284, 285, 295

[56] References Cited

U.S. PATENT DOCUMENTS

| | | | |
|---|---|---|---|
| 539,995 | 5/1895 | Nason | 242/158.2 |
| 2,968,446 | 1/1961 | Selby | 242/54.4 |
| 3,801,813 | 4/1974 | Kiehn | 362/403 X |
| 3,980,252 | 9/1976 | Tae | 242/158.3 |
| 4,012,001 | 3/1977 | Knox | 242/54 R |
| 4,429,355 | 1/1984 | Garchinsky | 362/403 |

*Primary Examiner*—Stephen F. Husar

*Attorney, Agent, or Firm*—Marshall, O'Toole, Gerstein, Murray & Bicknell

[57] ABSTRACT

A winch having a pair of first and second cylindrical drums; a drive to simultaneously axially rotate the drum; a reciprocating bracket which travels substantially axially parallel to the drums when the drums rotate; the bracket having a pair of spaced apart first and second rope guides; the first guide being capable of receiving a rope being level wound on, or unwound from, the first drum; and the second guide being capable of receiving a rope being level wound on, or unwound from, the second drum.

23 Claims, 3 Drawing Sheets

FIG. 3
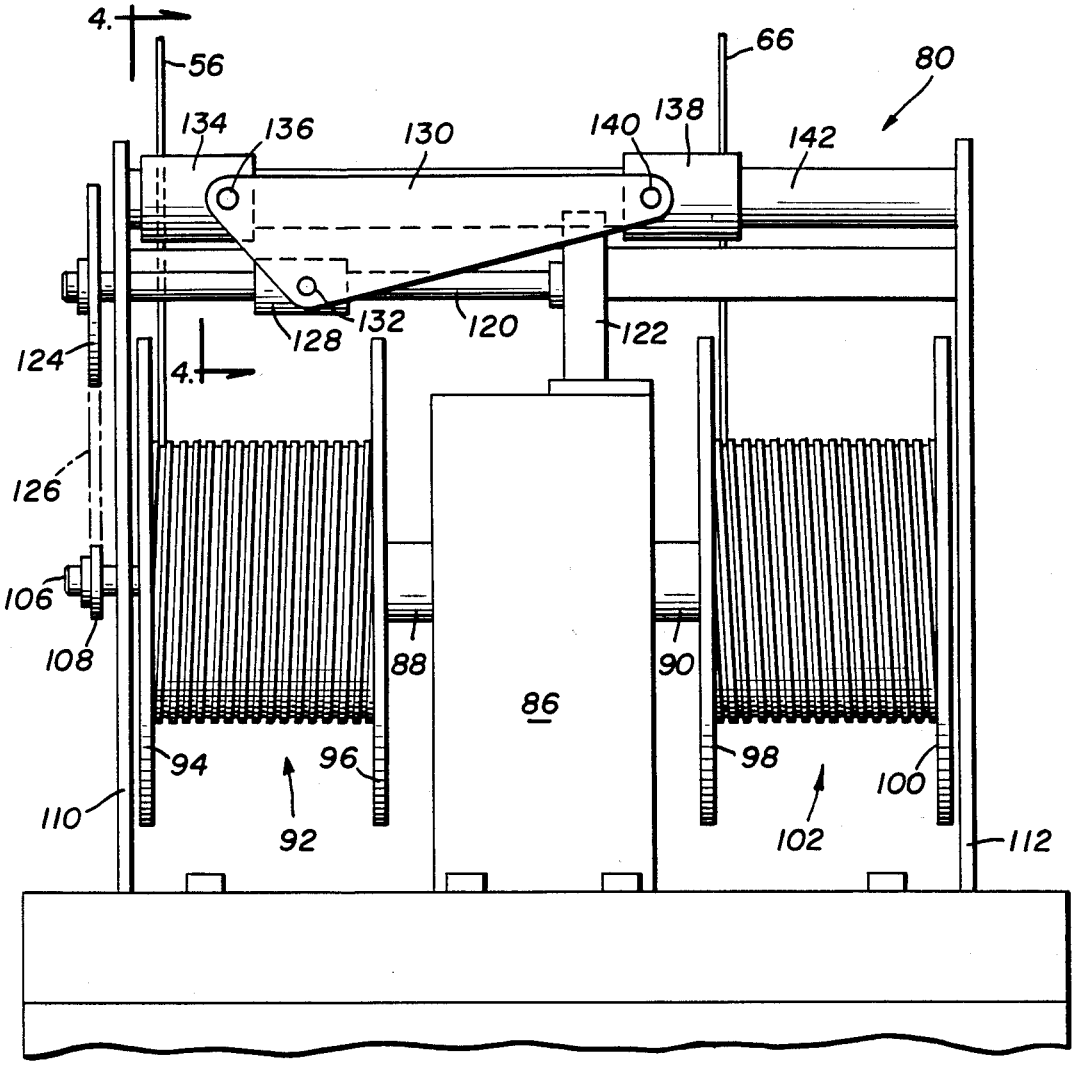
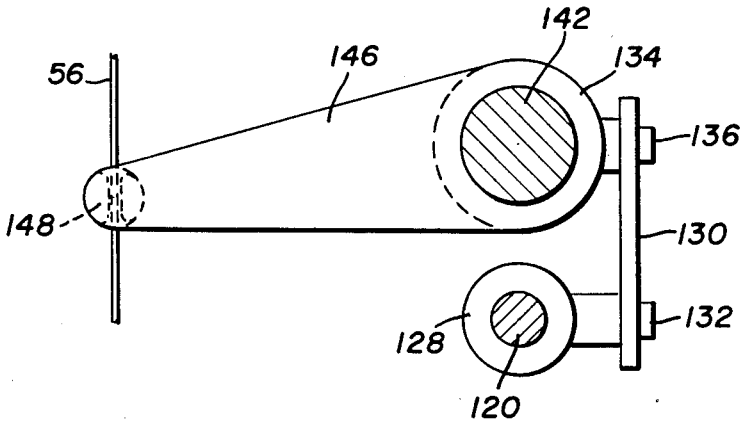
FIG. 4

DOUBLE DRUM LEVEL WINDING ROPE LIFT MECHANISM FOR LUMINAIRES ON HIGH LIGHTING MASTS

This invention relates to a winch apparatus having a pair of drums each of which has a wire rope which is wound thereon and unwound therefrom. More particularly, this invention is concerned with a winch of the described type having a mechanism for level winding the wire rope on each drum and the use of the winch to raise and lower a luminaire assembly or lighting fixture on a high mast.

BACKGROUND OF THE INVENTION

Winches are widely used for a wide variety of purposes when it is necessary to apply a tensile force. Although many winches are stationary they are also mounted on movable vehicles and portable equipment. The winches most widely used generally have a single drum on which a rope or wire rope is wound and then unwound as required by the use to which it is put. There are some uses, however, which require that a winch have at least two drums, with each drum carrying a separate rope or wire rope.

Knox U.S. Pat. No. 4,012,001 discloses a type of winch for reeling and unreeling wire for aerial spinning of suspension cables for a suspension bridge. It discloses two separate reels or drums which can rotate at different speeds. It also shows a level winding mechanism for each reel or drum which use separate drives and which are not synchronized one to the other so that the two reels are not necessarily level wound simultaneously.

Selby U.S. Pat. No. 2,968,446, although not directed to a winch, discloses a tube which reciprocates on a rod. The tube carries two sliver guides so that when the tube reciprocates the sliver is wound onto two separate spools rotated by frictional contact with a drum.

The described mechanisms upon careful study are not seen to be suitable for the controlled level winding of two ropes on different drums simultaneously followed by controlled level unwinding of the ropes from the drums. There is accordingly a need for such a winch apparatus, especially for use in luminaire assemblies movably mounted on a tall mast or pole.

SUMMARY OF THE INVENTION

According to one aspect of the invention a winch is provided having a pair of first and second cylindrical drums; drive means to simultaneously axially rotate the drums; a reciprocating bracket; means for reciprocating the bracket substantially axially parallel to the drums when the drums rotate; the bracket having a pair of spaced apart first and second rope guides; the first guide being capable of receiving a rope being level wound on, or unwound from, the first drum; and the second guide being capable of receiving a rope being level wound on, or unwound from, the second drum.

The drive means can rotate the pair of drums clockwise and counterclockwise. The drive means can include reversing means so it can rotate both drums axially clockwise at the same time and then rotate both drums axially counterclockwise at the same time.

Desirably, the drums are axially aligned with each other. Each drum can be fixedly mounted on a rotatable shaft so that the drum rotates with the shaft. Furthermore, the drums can be mounted on a common shaft.

The means for reciprocating the bracket can comprise a reversing screw means having a housing around and operatively engaging the screw whereby when the screw turns axially in either direction the housing travels reciprocally along the screw from end to end and back, and means connecting the bracket to the housing.

Both of the drums can have essentially the same axial length and diameter, and the guides can be spaced apart a distance which is substantially the same as the axial distance between the middle of the two drums. The bracket, furthermore, is sized to reciprocate for a distance essentially equal to the axial length of one of the drums.

The guides are desirably slidably mounted on a rod parallel to the reversing screw.

The winch can also include means so that rotation of the drums drives the means which reciprocates the bracket.

The winch, in addition, with each revolution of the drums can move the guides axially to the drums a distance substantially corresponding to the thickness of the rope.

According to a further aspect of the invention a lighting installation is provided comprising a vertical tall mast having a base portion supported by a foundation means; a luminaire assembly suspended from an upper portion of the mast by first and second ropes; a pair of first and second cylindrical drums located about at the mast base portion; a portion of the first rope being wound onto the first drum and a portion of the second rope being wound onto the second drum; drive means to simultaneously axially rotate the drums clockwise and counterclockwise; a reciprocating bracket; means for reciprocating the bracket substantially axially parallel to the drums when the drums rotate; the bracket having a pair of spaced apart first and second rope guides; the first guide receiving the first rope and the second guide receiving the second rope; and whereby when the drums rotate in one direction both of the ropes are unwound from the drums at the same rate thereby permitting the luminaire assembly to descend by gravity to a lower level, such as to the mast base, so that the luminaire assembly can be serviced; and when the drums are rotated in the opposite direction both of the ropes are wound onto the drums at the same rate thereby raising the luminaire assembly to the upper portion of the mast.

The previously described winch and the features which it desirably contains can be used in the lighting installation.

BRIEF DESCRIPTION OF THE DRAWINGS

FIG. 3 is a front elevational view of the luminaire hoist or winch apparatus including the pair of drums and rope level winding equipment;

FIG. 4 is a sectional view taken along the line 4—4 of FIG. 3;

DETAILED DESCRIPTION OF THE DRAWINGS

To the extent it is reasonable and practical the same or similar elements which appear in the various drawings will be identified by the same numbers.

Figure 1:
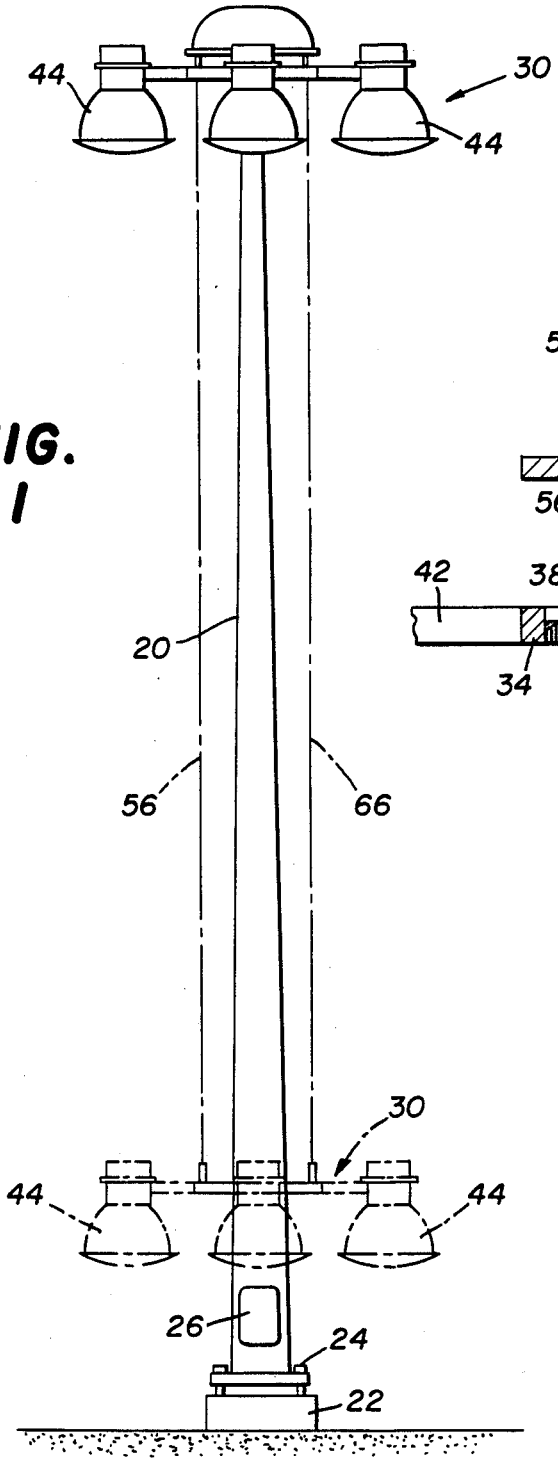
FIG. 1 is an elevational view of a high mast or pole having a lighting fixture or luminaire movably secured at the top by a pair of ropes which can be level wound on and unwound from a pair of drums mounted in the base.
Figure 2:
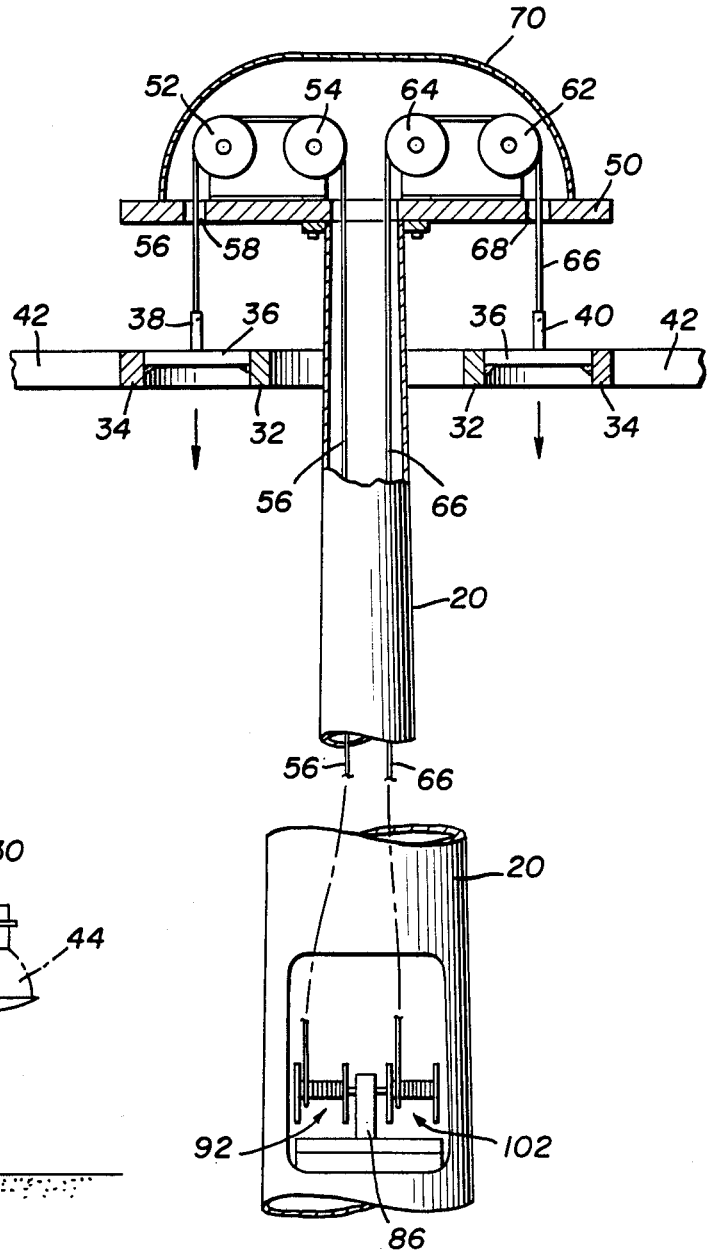
FIG. 2 is an enlarged view, partially in section, of the top and bottom portions of the apparatus illustrated in FIG. 1.
Figures 5, 6:
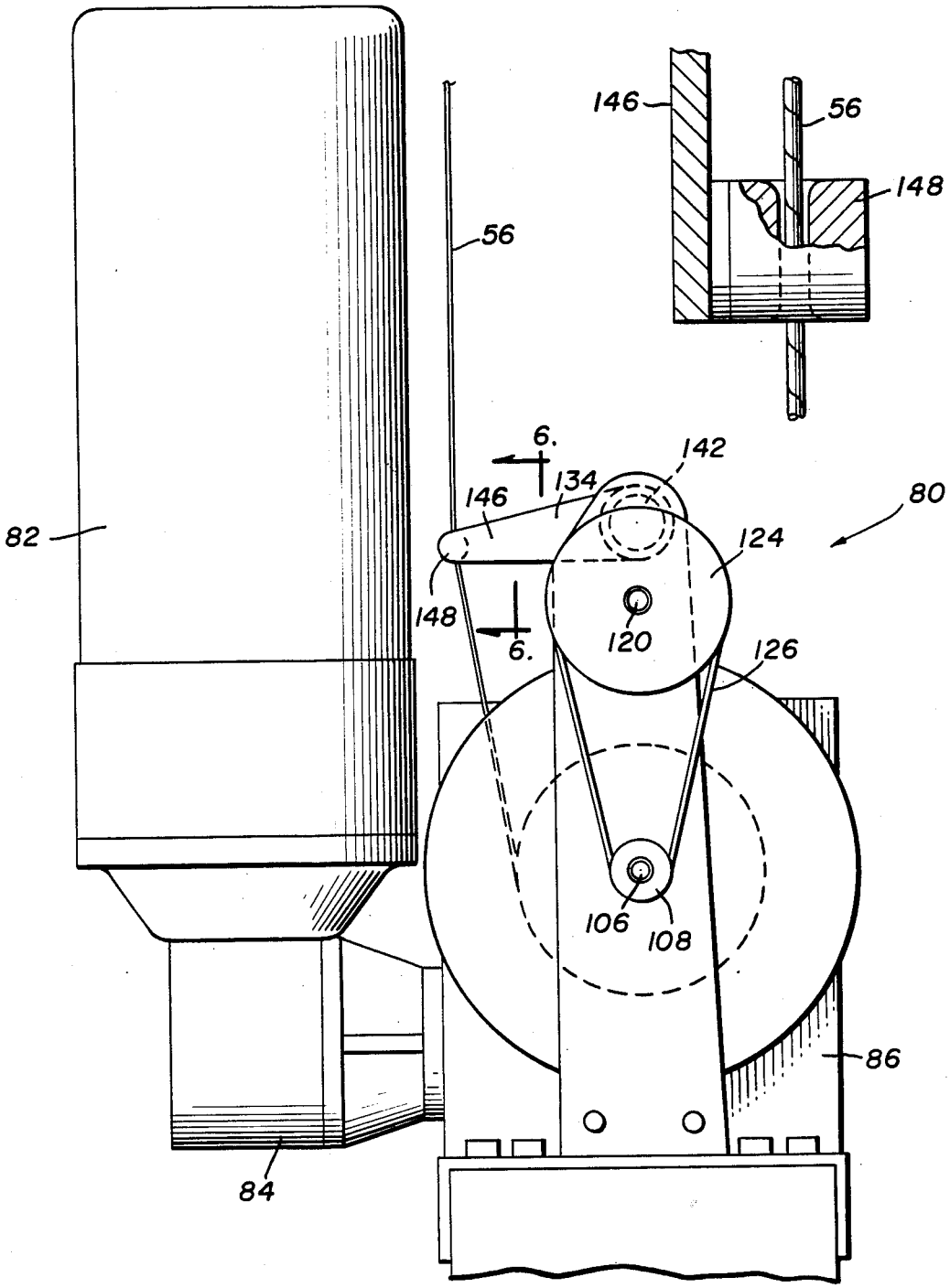
FIG. 5 is a side elevational view of the hoist or winch apparatus illustrated in FIG. 3.
FIG. 6 is a sectional view taken along the line 6—6 of FIG. 5.

With reference to FIG. 1, the hollow mast or pole 20 is secured to concrete foundation 22 by high strength bolts 24. An access door 26 is located in the base portion of the mast 20 so that the equipment therein can be installed and serviced. The mast can be of any height but generally will be fifty to one hundred and fifty feet or more high.

A vertical movable lighting fixture or luminaire assembly 30 when in service is positioned at or near the top of the mast 20. The luminaire assembly 30 can be of any configuration suitable for the intended purpose. The illustrated luminaire assembly has an inner substantially horizontal ring 32 and an outer substantially horizontal ring 34. The rings 32,34 are connected by a plurality of spokes 36. Attachments 38,40 project upwardly from a pair of diametrically opposed spokes 36.

A plurality of spokes 42 extend radially outwardly from the outer ring 34 and one or more luminaires 44 is attached to each spoke.

A platform beam 50 is mounted on the top of mast 20. A first pair of sheaves 52,54 is radially mounted on one side of the top of platform 50 so that a wire rope 56 connected at one end to attachment 38 can pass through hole 58 in the platform, run over the sheaves and then run downwardly inside of the hollow mast 20. Similarly, a second pair of sheaves 62,64 is radially mounted on the top of platform 50, diametrically opposite the first pair of sheaves 52,54, so that a wire rope 66 connected at one end to attachment 40 can pass through hole 68 in the platform, then run over the sheaves 62,64 and then run downwardly inside of the hollow mast 20. A weather cover 70 is mounted over the sheaves 52,54,62,64 and it rests on platform 50.

With reference to FIGS. 3 to 6, winch apparatus 80 is positioned inside the mast base portion behind access door 26 so that it can be installed and serviced readily at ground level.

The winch apparatus 80 includes an electric motor 82 which is operatively connected to gear box reducer 84. The motor 82 can be an enclosed fan cooled motor with a positive electric friction brake. The motor 82 engages a double reduction worm gear reducer 84 which is operatively engaged with gear box 86 having opposing shafts 88,90.

Drum or spool 92 is mounted on shaft 88 and drum or spool 102 is mounted on shaft 90. Since shafts 88,90 have a common axis the drums are axially aligned with each other. Furthermore, both shafts 88,90 can rotate clockwise or counterclockwise simultaneously. Reversing means is provided in the drive motor unit to obtain such rotation. Of course, both of the drums will thereby be rotated axially clockwise or counterclockwise with such movement of the shafts. The two drums 92,102 are essentially identical in all dimensions. Drum 92 has circular walls 94,96 at each end and drum 102 has circular walls 98,100 at each end. The axial distance between the end walls of each of the two drums is essentially identical as is the diameter of the cylindrical portion of each drum on which the wire rope is wound. Shaft 106 is connected to and extends outwardly from drum wall 94. Pulley 108 is mounted on shaft 106.

A pair of spaced apart vertical plates 110,112 support the wire rope level winding mechanism. Commercially available reversing screw or actuator 120 is supported at one end by support 122 and at the other end by plate 110. The end of reversing screw 120 has a pulley 124. Belt 126 runs over pulleys 108,124 so that when the drums 92,102 rotate in either direction the reversing screw 120 will rotate in the same direction. A Norco commercially available reversing screw or mechanical actuator can be used to provide the desired reciprocating motion to housing 128 by means of a ball reverser therein which causes the housing to reciprocate on a conventional diamond thread screw. Tae U.S. Pat. No. 3,980,252 discloses another form of reversing screw mechanism which also can be used.

The bottom of triangular shaped bracket 130 is connected to housing 128 by pin 132. The upper left end of bracket 130 is connected to first wire rope guide 134 by pin 136. The upper right end of bracket 130 is connected to second wire rope guide 138 by pin 140. Each of the wire rope guides 134,138 is slidably mounted on rod 142, the ends of which are respectively fixedly joined to vertical plates 110,112. The guides are spaced apart a distance which is substantially the same as the axial distance between the middles of the two drums which, of course, is the distance from wall 94 of drum 92 to wall 98 of drum 102. Such reciprocal action is achieved because the bracket can reciprocate for a distance substantially equal to the axial length of one of the drums.

The wire rope guide 134 has an outwardly extending arm 146 at the end of which is located a low friction slide 148 in which wire rope 56 can slide freely when being wound on or unwound from drum 92. Similarly, wire rope guide 138 has an outwardly extending arm like arm 146 at the end of which is located a low friction slide like slide 148 in which wire rope 66 can slide freely when being wound on or unwound from drum 102.

When the wire ropes 56,66 are in their respective slides 148, the wire ropes are spaced apart a distance which is essentially the same as the distance from the wall 94 of drum 92 to the wall 98 of drum 102 as shown in FIG. 3. Furthermore, when the wire ropes are being wound or unwound, the reversing screw 120 moves the housing 128, and also the guides 134,138, in a reciprocal travel path first to the right a distance essentially equal to the distance between the walls 94,96 of drum 92 before reversing direction and traveling left or in the opposite direction for an equal distance before again reversing direction and moving in the opposite direction to the right. In this way both of the wire ropes are simultaneously level wound on or unwound from the drums. To further facilitate level winding of the wire ropes on their respective drums, the reversing screw 120 should drive the housing 128 axially for a distance about equal to the thickness of the wire ropes 56,66, which desirably are of identical thickness, for each revolution of the drums 92,102.

As shown in FIG. 1 when it is desired to raise the luminaire assembly 30 to the top of mast 20 during installation, the winch motor 82 is energized to thereby rotate the drums to wind the wire ropes 56,66 on their respective drums. As the wire ropes wind on the drums they pull the luminaire assembly 30 up the last with the mast centered in ring 32. When the luminaire assembly 30 is raised to the top of the mast 20 the attachments 30,40 enter the respective holes 58,68 and ring 32 is pressed against the bottom of support beam 50, thereby securing the luminaire assembly in place. A locking mechanism, not shown, is then engaged to keep the winch drums from rotating.

When it is desired to lower the luminaire assembly to ground level so that it can be serviced the described procedure is reversed by simply placing the winch in reverse operation.

The foregoing detailed description has been given for clearness of understanding only, and no unnecessary limitations should be understood therefrom, as modifications will be obvious to those skilled in the art.

What is claimed is:

1. A winch apparatus comprising:

a pair of first and second cylindrical drums;

drive means to simultaneously axially rotate the drums;

a reciprocating bracket;

means for reciprocating the bracket substantially axially parallel to the drums when the drums rotate;

the bracket having a pair of spaced apart first and second rope guides;

the first guide being capable of receiving a rope being level wound on, or unwound from, the first drum; and the second guide being capable of receiving a rope being level wound on, or unwound from, the second drum.

2. A winch apparatus according to claim 1 in which the drive means can rotate the pair of drums clockwise and counterclockwise.

3. A winch apparatus according to claim 2 in which the drive means includes reversing means so it can rotate both drums axially clockwise at the same time and then rotate both drums axially counterclockwise at the same time.

4. A winch apparatus according to claim 1 in which the drums are axially aligned with each other.

5. A winch apparatus according to claim 4 in which each drum is fixedly mounted on a rotatable shaft so that the drum rotates with the shaft.

6. A winch apparatus according to claim 5 in which the drums are mounted on a common shaft.

7. A winch apparatus according to claim 1 in which the means for reciprocating the bracket comprises a reversing screw means having a housing around and operatively engaging the screw whereby when the screw turns axially in either direction the housing travels reciprocally along the screw from end to end and back, and means connecting the bracket to the housing.

8. A winch apparatus according to claim 1 in which both of the drums have essentially the same axial length and diameter, and the guides are spaced apart a distance which is substantially the same as the axial distance between the middles of the two drums.

9. A winch apparatus according to claim 8 in which the bracket can reciprocate for a distance substantially equal to the axial length of one of the drums.

10. A winch apparatus according to claim 7 in which the guides include sleeves slidably mounted on a rod parallel to the reversing screw.

11. A winch apparatus according to claim 7 in which rotation of the drums drives the means which reciprocates the bracket.

12. A winch apparatus according to claim 1 in which with each revolution of the drums the guides move axially to the drums a distance substantially corresponding to the thickness of the rope.

13. A lighting installation comprising:

a vertical tall mast having a base portion supported by a foundation means;

a lighting fixture suspended from an upper portion of the mast by first and second ropes;

a pair of first and second cylindrical drums located about at the mast base portion;

a portion of the first rope being wound onto the first drum and a portion of the second rope being wound onto the second drum;

drive means to simultaneously axially rotate the drums clockwise and counterclockwise;

a reciprocating bracket;

means for reciprocating the bracket substantially axially parallel to the drums when the drums rotate;

the bracket having a pair of spaced apart first and second rope guides;

the first guide receiving the first rope and the second guide receiving the second rope; and whereby when the drums rotate in one direction both of the ropes are unwound from the drums at the same rate thereby permitting the lighting fixture to descend by gravity to a lower level, such as to the mast base, so that the lighting fixture can be serviced; and when the drums are rotated in the opposite direction both of the ropes are wound onto the drums at the same rate thereby raising the lighting fixture to the upper portion of the mast.

14. A lighting installation according to claim 13 in which the drive means includes reversing means so it can rotate both drums axially clockwise at the same time and then rotate both drums axially counterclockwise at the same time.

15. A lighting installation according to claim 13 in which the drums are axially aligned with each other.

16. A lighting installation according to claim 15 in which each drum is fixedly mounted on a rotatable shaft so that the drum rotates with the shaft.

17. A lighting installation according to claim 16 in which the drums are mounted on a common shaft.

18. A lighting installation according to claim 13 in which the means for reciprocating the bracket comprises a reversing screw means having a housing around and operatively engaging the screw whereby when the screw turns axially in either direction the housing travels reciprocally along the screw from end to end and back, and means connecting the bracket to the housing.

19. A lighting installation according to claim 13 in which both of the drums have essentially the same axial length and diameter, and the guides are spaced apart a distance which is substantially the same as the axial distance between the middles of the two drums.

20. A lighting installation according to claim 19 in which the bracket can reciprocate for a distance substantially equal to the axial length of the drum.

21. A lighting installation according to claim 18 in which the guides include sleeves slidably mounted on a rod parallel to the reversing screw.

22. A lighting installation according to claim 18 in which rotation of the drums drives the means which reciprocates the bracket.

23. A lighting installation according to claim 13 in which with each revolution of the drums, the guides move axially to the drums a distance substantially corresponding to the thickness of the rope.

* * * * *